US009702373B2

(12) United States Patent
Uehara et al.

(10) Patent No.: US 9,702,373 B2
(45) Date of Patent: Jul. 11, 2017

(54) SINGLE SUCTION TYPE CENTRIFUGAL FAN

(71) Applicant: Panasonic Corporation, Osaka (JP)

(72) Inventors: Akimasa Uehara, Aichi (JP); Satoshi Ousaka, Aichi (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 323 days.

(21) Appl. No.: 14/476,755

(22) Filed: Sep. 4, 2014

(65) Prior Publication Data

US 2015/0086348 A1 Mar. 26, 2015

(30) Foreign Application Priority Data

Sep. 24, 2013 (JP) ..... 2013-196437

(51) Int. Cl.
*F04D 29/42* (2006.01)
*F04D 25/08* (2006.01)
*F04D 29/68* (2006.01)

(52) U.S. Cl.
CPC ..... *F04D 29/4206* (2013.01); *F04D 25/082* (2013.01); *F04D 29/685* (2013.01)

(58) Field of Classification Search
CPC .. F04D 29/4206; F04D 25/082; F04D 29/685; F04D 29/4213; F04D 29/4226; F04D 29/4233; F04D 29/04
USPC ..... 415/204, 206; 416/187, 186 R, 223 B; 417/369, 370
See application file for complete search history.

(56) References Cited

U.S. PATENT DOCUMENTS 3,598,502 A * 8/1971 Paish ..... F04D 1/006 415/204
4,253,798 A * 3/1981 Sugiura ..... F04D 29/2255 415/204
4,913,620 A * 4/1990 Kusiak ..... F04D 9/00 415/169.1
5,570,996 A * 11/1996 Smiley, III ..... F04D 29/4226 415/204
5,967,764 A * 10/1999 Booth ..... H02K 9/06 416/169 A (Continued)

FOREIGN PATENT DOCUMENTS

JP 08-284894 A 10/1996
JP 2012-140884 7/2012

*Primary Examiner* — Kenneth Bomberg
*Assistant Examiner* — Brian Delrue
(74) *Attorney, Agent, or Firm* — Panasonic IP Management; Kerry S. Culpepper

(57) ABSTRACT

A single suction type centrifugal includes: a casing; and an impeller housed in the casing and provided with a plurality of blades fixed to an impeller main plate. The casing includes a suction side plate having a suction port, and a motor fixing side plate. A center portion of the impeller main plate is fixed to the motor, and a main plate opening is formed in the impeller main plate between the blades and a center portion of the impeller main plate. A blade end portion imaginary plane passes end portions of the blades on a motor fixing side plate side and is perpendicular to a rotary shaft of the motor. A constriction portion is formed where a distance between the blade end portion imaginary plane and the motor fixing side plate is narrowed between the main plate opening and the blades.

6 Claims, 5 Drawing Sheets

(56) References Cited

U.S. PATENT DOCUMENTS 6,135,731 A * 10/2000 Woollenweber ..... F04D 25/06 415/912
6,428,288 B1 * 8/2002 King ..... F04D 25/082 415/176
6,488,475 B2 * 12/2002 Murata ..... A47L 5/22 417/32
6,575,695 B1 * 6/2003 Miyamoto ..... A01G 1/125 15/326
9,039,360 B2 * 5/2015 Fukuda ..... F04D 29/162 415/204
2002/0150478 A1 * 10/2002 Aoki ..... B60H 1/00457 417/44.1
2004/0126228 A1 * 7/2004 Roudnev ..... F04D 29/426 415/196
2005/0103042 A1 * 5/2005 Sanagi ..... F04D 25/082 62/419
2005/0191174 A1 * 9/2005 Zeng ..... F04D 29/162 415/206
2006/0034686 A1 * 2/2006 Smiley, III ..... F04D 29/4226 415/204
2006/0198729 A1 * 9/2006 Yamasaki ..... F04D 29/162 415/206
2007/0016328 A1 * 1/2007 Ziegler ..... A47L 5/14 700/245
2007/0098556 A1 * 5/2007 Sanagi ..... F04D 29/282 416/182
2007/0201976 A1 * 8/2007 Higashida ..... F04D 29/162 415/206
2008/0095629 A1 * 4/2008 Eguchi ..... F04D 29/282 416/179
2009/0123285 A1 * 5/2009 Sinzaki ..... F04D 29/281 416/178
2009/0214334 A1 * 8/2009 Fukami ..... F04D 29/4213 415/206
2010/0196174 A1 * 8/2010 Lee ..... F04D 25/082 417/410.1
2010/0322762 A1 * 12/2010 Shirahama ..... F04D 29/282 415/204
2010/0322773 A1 * 12/2010 Yoo ..... A47L 5/22 416/204 R
2011/0002775 A1 * 1/2011 Ma ..... F04D 29/664 415/119
2012/0045338 A1 * 2/2012 Tadokoro ..... F04D 29/30 416/196 R
2012/0057972 A1 * 3/2012 Kim ..... B60H 1/00507 415/204
2012/0114512 A1 * 5/2012 Lofy ..... F04D 29/4226 417/410.1
2012/0315135 A1 * 12/2012 Sato ..... F04D 29/30 415/204
2013/0051974 A1 * 2/2013 Poon ..... F04D 29/4206 415/1
2013/0121818 A1 * 5/2013 Shichiken ..... F04D 17/16 415/204
2013/0243585 A1 * 9/2013 Sinzaki ..... F04D 29/4213 415/204
2013/0330182 A1 * 12/2013 Kim ..... F04D 29/162 415/204
2014/0161602 A1 * 6/2014 Schmidt ..... F04D 29/4226 415/204
2014/0255175 A1 * 9/2014 Zheng ..... F04D 29/444 415/204
2015/0044077 A1 * 2/2015 Huang ..... F04D 25/082 417/423.8
2015/0071773 A1 * 3/2015 Takahashi ..... F04D 29/4293 415/204
2015/0086348 A1 * 3/2015 Uehara ..... F04D 29/4206 415/204
2015/0157818 A1 * 6/2015 Darby ..... A61M 16/0069 128/201.13
2015/0192147 A1 * 7/2015 An ..... F04D 29/4213 415/58.4
2015/0260198 A1 * 9/2015 Aiello ..... F04D 29/4213 415/206
2015/0267714 A1 * 9/2015 Irwin ..... F04D 1/00 415/204
2016/0047386 A1 * 2/2016 Uehara ..... F04D 29/4226 415/204
2016/0090993 A1 * 3/2016 Uehara ..... F04D 29/441 415/204
2016/0153457 A1 * 6/2016 Jang ..... B60H 1/00471 415/204
2016/0186771 A1 * 6/2016 Evers ..... H02K 9/06 416/90 R

* cited by examiner

SINGLE SUCTION TYPE CENTRIFUGAL FAN

BACKGROUND OF THE INVENTION

1. Field of the Invention

The present disclosure relates to a structure of a ventilation fan such as a duct fan or a structure of a single suction type centrifugal fan used in an air conditioner or the like.

2. Description of the Related Art

In recent years, a centrifugal fan has been requested to acquire a higher static pressure to cope with a tendency that duct piping connected to the centrifugal fan becomes more complicated or airtightness of a building is increased. As the configuration of a conventional single suction type centrifugal fan which realizes the higher static pressure, there has been known a centrifugal fan having a turbulence suppressing plate which is disposed in a vicinity of a tongue portion and on an inner peripheral portion side of blades of an impeller, and which extends along the radial direction of the impeller.

Hereinafter, such a conventional example is described with reference to FIG. 5A and FIG. 5B.

As shown in FIG. 5A and FIG. 5B, single suction type centrifugal fan 101 is formed of casing 102, and impeller 103 housed in casing 102. Casing 102 is formed of suction-side plate 105 having suction opening 104, vortex-like scroll 106, and motor fixing side plate 108 to which motor 107 is fixed. One end of scroll 106 is connected to suction-side plate 105 and the other end of scroll 106 is connected to motor fixing side plate 108. Casing 102 is formed in a spiral shape such that a flow passage cross-sectional area (radial cross-sectional area in a region surrounded by an outer peripheral side of impeller 103, an inner side of scroll 106, suction-side plate 105, and motor fixing side plate 108) is gradually enlarged along rotational direction 110 of impeller 103 from tongue portion 109.

Impeller 103 is fixedly connected to motor 107. When impeller 103 is rotated by driving motor 107, suction gas flow 111 flows into casing 102 from intake port 104 by way of impeller 103. Air blown off from impeller 103 is boosted in spiral casing 102, a pressure of the air is converted into a static pressure from a dynamic pressure, and the gas flows out from discharge port 112 as discharge gas flow 113.

When a high static pressure is applied to the centrifugal fan due to a tendency that duct piping connected to the centrifugal fan becomes more complicated or airtightness of a building is increased, that is, when the centrifugal fan is used on a shutoff side on performance (PQ: Static Pressure (Pressure)-Air quantity (Quantity)) curve, discharge gas flow 113 does not flow out as a laminar flow. The shutoff side is the point of zero airflow on the static pressure curve. As a result, in the vicinity of tongue portion 109, tongue portion turbulence 114 occurs which flows backward into the inside of impeller 103 from the inside of casing 102. The centrifugal fan boosts a pressure of a gas flow by spiral casing 102 which starts from tongue portion 109. However, in the case of the generally used single suction type centrifugal fan, a gas flow at a pressure boosting start position in the vicinity of tongue portion 109 becomes turbulent due to tongue portion turbulence 114 and hence, pressure boosting start position is retracted. As a result, a pressure is not sufficiently boosted by spiral casing 102 thus giving rise to a drawback that performance (static pressure) on a shut-off side is lowered. To cope with such a drawback, in single suction type centrifugal fan 101 described in Unexamined Japanese Patent Publication No. 8-284894, as shown in FIG. 5A and FIG. 5B, turbulence suppressing plate 116 is disposed in the vicinity of tongue portion 109 and on an inner peripheral portion side of blades 115 of impeller 103. Turbulence suppressing plate 116 is fixed to suction-side plate 105 of casing 102 and is formed into a shape extending in a radial direction of impeller 103 in a state where turbulence suppressing plate 116 is disposed close to blades 115. Due to the provision of turbulence suppressing plate 116, the direction of a gas flow is converted from tongue portion turbulence 114 generated when a high static pressure is applied to the device to gas flow 117 which is directed to a center portion of impeller 103. That is, with the provision of turbulence suppressing plate 116, it is possible to suppress the inflow of tongue portion turbulence 114 into the pressure boosting start position in the vicinity of tongue portion 109 thus suppressing the retraction of the pressure boosting start position. As a result, sufficient boosting of pressure can be acquired by spiral casing 102 so that performance (static pressure) on a shutoff side can be increased.

In such conventional single suction type centrifugal fan 101, performance (static pressure) on a shutoff side can be increased. However, since turbulence suppressing plate 116 is disposed in a gas flow passage, on an open side on a performance (PQ) curve, that is, in the case where an amount of outflow air is large and at maximum, gas flow noises which occur due to impingement of a gas flow on turbulence suppressing plate 116 are liable to be generated. Further, turbulence suppressing plate 116 and blades 115 of impeller 103 are disposed close to each other and hence, parts are required to satisfy working accuracy and assembly accuracy thus giving rise to a drawback that a working cost and assembling man-hours are increased.

It is an object of the present disclosure to provide a single suction type centrifugal fan which can acquire a high static pressure on a shutoff side on a performance (PQ) curve without additionally providing a part such as a turbulence suppressing plate to a product.

SUMMARY OF THE INVENTION

A single suction type centrifugal fan according to the present disclosure includes: a casing having a spiral shape; and an impeller housed in the casing and provided with a plurality of blades and an impeller main plate to which the blades are fixed. The casing includes a suction side plate having a suction port, and a motor fixing side plate to which a motor is fixed. A center portion of the impeller main plate is fixed to the motor. A main plate openings are formed in the impeller main plate between the blades and a center portion of the impeller main plate. A constriction portion is formed where a distance between a blade end portion imaginary plane and the motor fixing side plate becomes narrower between the main plate opening and the blades, where the blade end portion imaginary plane is defined as a plane which passes end portions of the blades on a motor fixing side plate side and is perpendicular to a rotary shaft of the motor. A constriction portion is formed where a distance between the blade end portion imaginary plane and the motor fixing side plate is narrowed between the main plate opening and the blades.

According to the present disclosure, by forming the constriction portion, a rotary shaft surrounding space, which is communicated with the inside of the casing through the constriction portion, is formed between the impeller main plate and the motor fixing side plate in a state where the rotary shaft surrounding space surrounds the rotary shaft of the motor. The rotary shaft surrounding space is communicated with the impeller through the main plate opening formed in the impeller main plate and hence, gas in the rotary shaft surrounding space is pulled toward an impeller side due to the rotation of the impeller whereby a gas pressure in the rotary shaft surrounding space becomes a negative pressure. When a high static pressure is applied to the device, that is, when the device is used on a shutoff side on a performance (PQ) curve, a pressure is boosted by the impeller and the casing, and part of gas flows out into the inside of the casing is introduced into the rotary shaft surrounding space where the gas pressure is a negative pressure from the inside of the casing where the gas pressure is a positive pressure through the constriction portion. Gas which flows into the rotary shaft surrounding space through the constriction portion flows into the impeller through the main plate opening, and a pressure of the gas is boosted again by the impeller and the casing. Due to such operation, a static pressure when the centrifugal fan is used on a shutoff side on a performance (PQ) curve can be increased.

Further, due to the provision of the constriction portion formed between the inside of the casing and the rotary shaft surrounding space, it is possible to prevent a phenomenon where gas having a high flow speed in the casing, flows into the rotary shaft surrounding space in a single stroke. Accordingly, the centrifugal fan also has a function of making a gas flow in the rotary shaft surrounding space, smoothly flow into the impeller without generating turbulence.

Accordingly, the present disclosure can provide a single suction type centrifugal fan which can acquire a high static pressure when the device is used on a shutoff side on a performance (PQ) curve without additionally providing a part such as a turbulence suppressing plate to a product.

DETAILED DESCRIPTION OF THE PREFERRED EMBODIMENTS

Hereinafter, embodiments of the present disclosure are described with reference to the drawings.

First Exemplary Embodiment

Figure 1B:
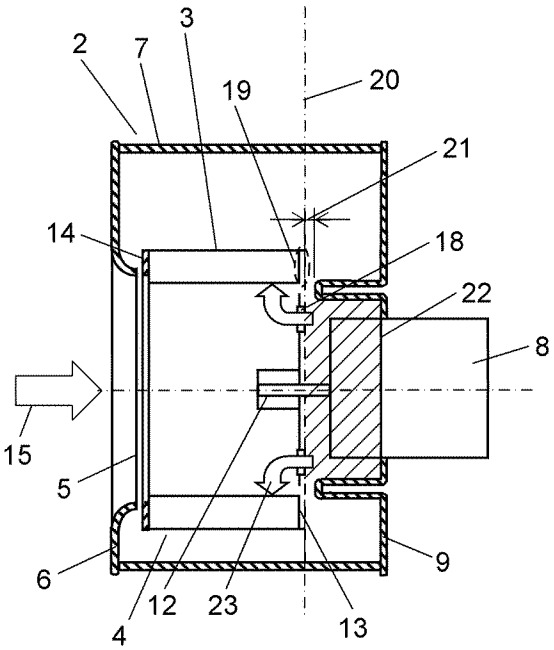
FIG. 1B is a front cross-sectional view showing a configuration of the single suction type centrifugal fan according to the first exemplary embodiment of the present disclosure.
Figure 1A:
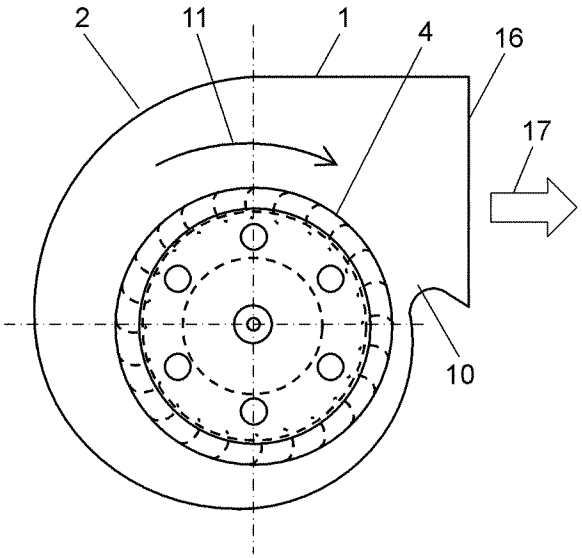
FIG. 1A is a side view showing a configuration of a single suction type centrifugal fan according to a first exemplary embodiment of the present disclosure.

As shown in FIGS. 1A-1B, single suction type centrifugal fan 1 according to a first exemplary embodiment of the present disclosure includes casing 2 and impeller 4 which is housed in casing 2 and having a plurality of blades 3.

Casing 2 includes suction side plate 6 having suction port 5, spiral shape 7, and motor fixing side plate 9 to which motor 8 is fixed. One end of scroll 7 is connected to suction side plate 6, and the other end of scroll 7 is connected to motor fixing side plate 9. Casing 2 is formed in a spiral shape such that a flow passage cross-sectional area (radial cross-sectional area in a region surrounded by an outer peripheral side of impeller 4, an inner side of scroll 7, suction side plate 6, and motor fixing side plate 9) is gradually enlarged along rotational direction 11 of impeller 4 from tongue portion 10.

Impeller 4 includes impeller main plate 13 which is fixedly connected to rotary shaft 12 of motor 8, and a plurality of blades 3 which are mounted on an outer peripheral side of impeller main plate 13 in an erected manner. An auxiliary ring 14 is fixed to distal ends of blades 3 on a side opposite to proximal portions of blades 3 fixed to impeller main plate 13.

Auxiliary ring 14 forms an opening in a center portion thereof, and the opening forms an impeller suction port which is communicated with suction port 5.

Impeller main plate 13 is provided to a motor 8 side of blades 3, and a center portion of impeller main plate 13 is fixedly connected to rotary shaft 12 of motor 8.

When impeller 4 is rotated by driving motor 8, suction gas flow 15 flows into casing 2 from intake port 5 by way of impeller 4. A pressure of suction gas flow 15 is boosted in spiral casing 2, the boosted pressure is converted into a static pressure from a dynamic pressure, and suction gas flow 15 flows out from discharge port 16 as discharge gas flow 17.

Main plate openings 18 are formed in impeller main plate 13 between blades 3 and a fixing portion where impeller main plate 13 is fixed to the rotary shaft of motor 8. In other words, main plate openings 18 are formed in impeller main plate 13 between blades 3 and the center portion of impeller main plate 13.

Here, a plane which passes end portions 19 of blades 3 on a motor fixing side plate 9 side and is perpendicular to rotary shaft 12 of the motor 8 is assumed as blade end portion imaginary plane 20.

Motor fixing side plate 9 is fixed substantially parallel to blade end portion imaginary plane 20 except for a portion of motor fixing side plate 9 projecting toward blade end portion imaginary plane 20.

Constriction portion 21 where a distance between blade end portion imaginary plane 20 and motor fixing side plate 9 is narrowed between main plate opening 18 and blades 3 is formed between blade end portion imaginary plane 20 and motor fixing side plate 9.

Here, a distance between blade end portion imaginary plane 20 and motor fixing side plate 9 is a distance directed in the direction parallel to rotary shaft 12.

A region between main plate openings 18 and blades 3 where constriction portion 21 is formed means a region formed on a side opposite to rotary shaft 12 (outer side) and more radially away from the rotary shaft 12 than main plate openings 18 within a region formed on a more rotary shaft 12 side (inner side) than blades 3.

Constriction portion 21 is formed by projecting a portion of motor fixing side plate 9 in the direction toward blade end portion imaginary plane 20.

By forming constriction portion 21, rotary shaft surrounding space 22 (hatched line portion) which is communicated with casing 2 through constriction portion 21 is formed between impeller main plate 13 and motor fixing side plate 9 in a state where rotary shaft surrounding space 22 surrounds rotary shaft 12 of motor 8.

Rotary shaft surrounding space 22 is communicated with the inside of impeller 4 through main plate openings 18 formed in impeller main plate 13.

The operation and advantageous effects acquired by the above-mentioned configuration are described.

When impeller 4 is rotated, gas in rotary shaft surrounding space 22 is pulled toward an impeller 4 side so that a gas pressure in space 22 becomes a negative pressure. When a high static pressure is applied to the device, that is, when the device is used on a shutoff side on a performance (PQ) curve, a pressure of the gas is boosted by impeller 4 and casing 2. Then, part of gas which flows out into casing 2 is introduced into rotary shaft surrounding space 22 where a gas pressure is a negative pressure from casing 2 where a gas pressure is a positive pressure through constriction portion 21. Gas which flows into rotary shaft surrounding space 22 becomes gas flow 23 which flows into impeller 4 through main plate openings 18, and a pressure of gas flow 23 is boosted by impeller 4 and casing 2 again.

By setting the position of constriction portion 21 in the radial direction of impeller 4 to a position within an area ranging from main plate openings 18 formed in impeller main plate 13 to blades 3, it is possible to prevent a gas flow from directly flowing into impeller 4 from casing 2 through main plate openings 18. Further, due to the provision of constriction portion 21 between the inside of casing 2 and rotary shaft surrounding space 22, it is possible to prevent a phenomenon that gas having a high flow speed in casing 2 flows into rotary shaft surrounding space 22 in a single stroke. Accordingly, a gas flow in the rotary shaft surrounding space 22 can smoothly flow into impeller 4 through main plate openings 18 without generating turbulence.

When the device is used on an open side on the performance (PQ) curve, that is, on a side where an amount of outflow gas is large, a pressure of the gas is boosted by impeller 4 and casing 2, and the gas which flows out into casing 2 smoothly flows out to the outside of casing 2 from discharge port 16 as discharge gas flow 17. Accordingly, a gas pressure in casing 2 does not become a positive pressure. Further, casing 2 and rotary shaft surrounding space 22 are partitioned from each other by providing constriction portion 21 and hence, a gas flow minimally flows into rotary shaft surrounding space 22 from the inside of casing 2. That is, when the device is used on a shutoff side on the performance (PQ) curve, compared to the case where the device is used on an open side on the performance (PQ) curve, a usable volume of casing 2 can be increased by an amount of rotary shaft surrounding space 22.

Figure 5B:
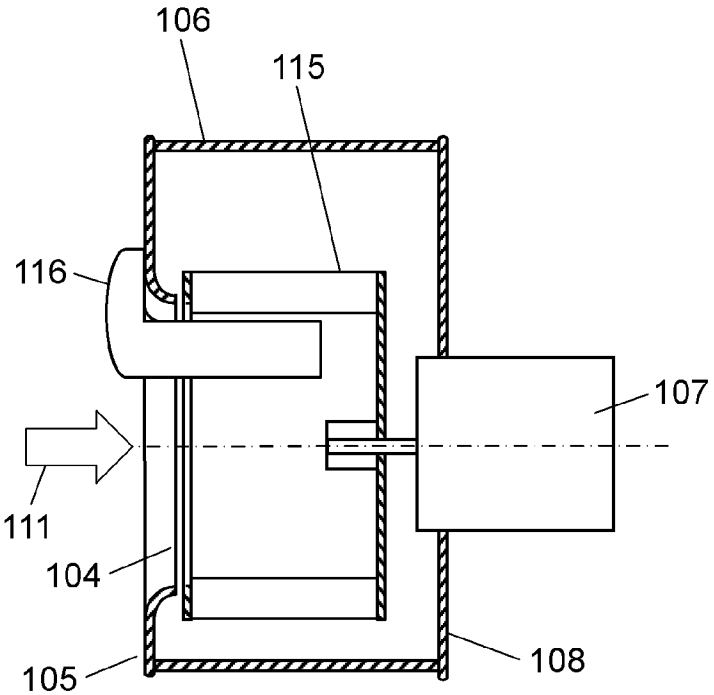
FIG. 5B PRIOR ART
FIG. 5B is a front cross-sectional view showing a configuration of the conventional single suction type centrifugal fan.
Figure 5A:
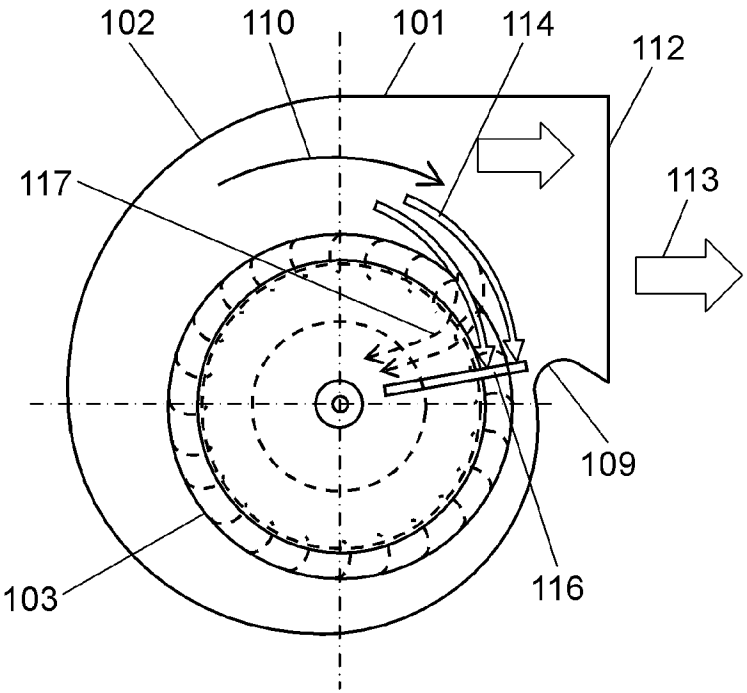
FIG. 5A PRIOR ART
FIG. 5A is a side view showing a configuration of a conventional single suction type centrifugal fan.

In a general-use centrifugal fan, when the device is used on a shutoff side on the performance (PQ) curve, discharge gas flow 17 does not flow out as a laminar flow. As a result, tongue portion turbulence 114 shown in FIG. 5A which flows backward toward the inside of impeller 4 from the inside of casing 2 is generated in the vicinity of tongue portion 10.

According to the present disclosure, when the device is used on a shutoff side on the performance (PQ) curve, a usable volume of casing 2 is increased by an amount of rotary shaft surrounding space 22 and hence, the stagnation of a gas flow in casing 2 can be suppressed thus suppressing the generation of tongue portion turbulence which occurs in the conventional centrifugal fan.

In this exemplary embodiment, main plate opening 18 is formed in a circular shape. However, main plate opening 18 may be formed in any shapes such as an elliptical shape or a polygonal shape provided that main plate opening 18 is communicated with the inside of impeller 4.

In this exemplary embodiment, constriction portion 21 is formed by forming a projecting portion on motor fixing side plate 9 by bending. However, constriction portion 21 may be formed by fixing an additional part which is formed into a ring shape to motor fixing side plate 9. In this case, the additional part fixed to motor fixing side plate 9 becomes a part of motor fixing side plate 9.

Figure 2B:
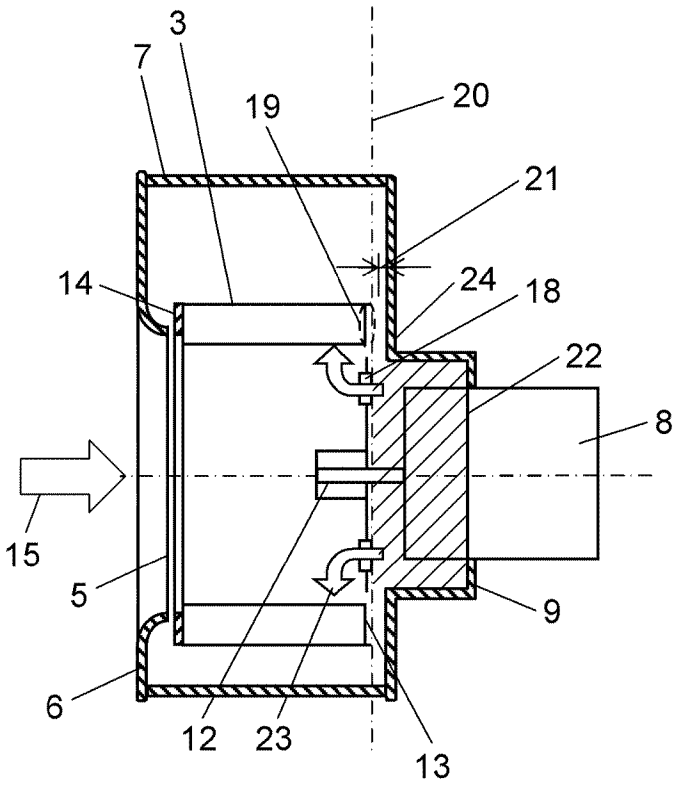
FIG. 2B is a front cross-sectional view showing a configuration of another single suction type centrifugal fan according to the first exemplary embodiment of the present disclosure.
Figure 2A:
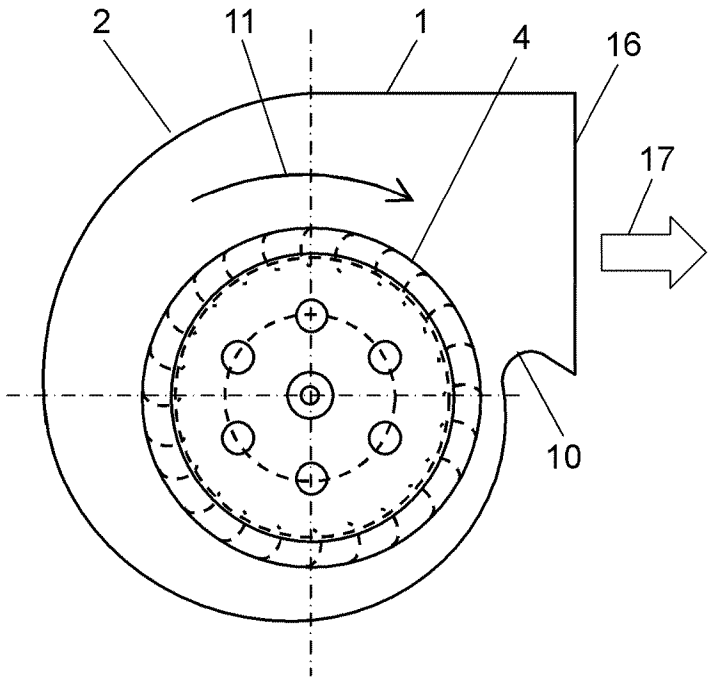
FIG. 2A is a side view showing a configuration of another single suction type centrifugal fan according to the first exemplary embodiment of the present disclosure.

As shown in FIG. 2A and FIG. 2B, constriction portion 21 may be formed by providing a bent portion 24 to the motor fixing side plate 9.

As shown in FIG. 1B and FIG. 2B, a width of constriction portion 21, that is, a distance between blade end portion imaginary plane 20 and motor fixing side plate 9 in constriction portion 21 in the direction parallel to rotary shaft 12 is preferably set to a value which falls within a range from 1 mm to 10 mm. It is needless to say, however, that even when the width of constriction portion 21 is set to a value which does not fall within the range from 1 mm to 10 mm, single suction type centrifugal fan 1 can acquire the advantageous effects of the present disclosure.

In this exemplary embodiment, constriction portion 21 is formed in the vicinity of end portions 19 of blades 3, and constriction portion 21 is formed between an area in the vicinity of end portions 19 of blades 3 and motor fixing side plate 9. However, it is sufficient that constriction portion 21 is formed between main plate openings 18 and blades 3 and hence, constriction portion 21 may be provided in an area other than the area in the vicinity of end portions 19 of blades 3.

Figure 3:
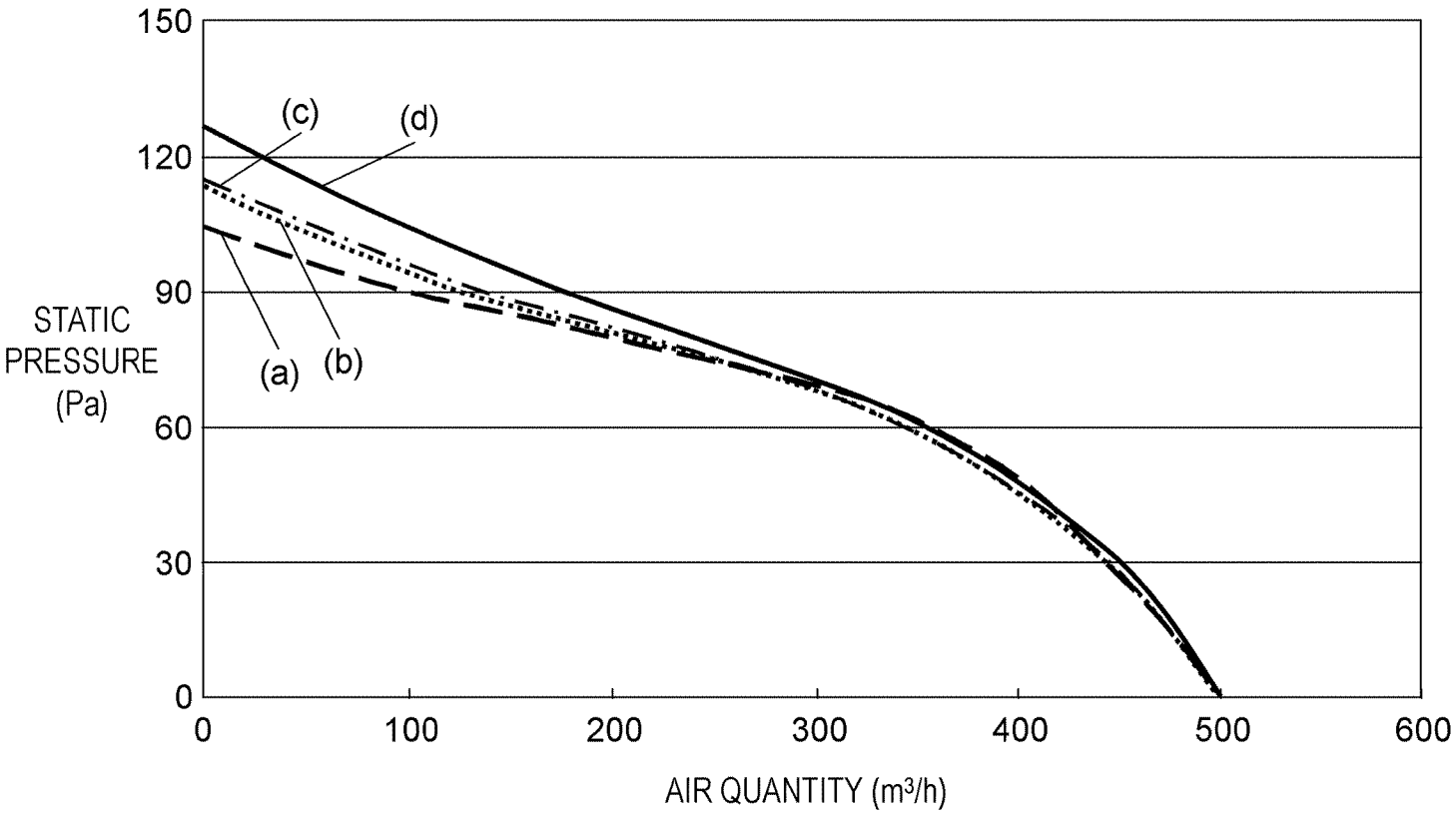
FIG. 3 is a comparison graph of PQ (static pressure—air quantity) characteristics of various single suction type centrifugal fans including the single suction type centrifugal fan of the first exemplary embodiment of the present disclosure.

FIG. 3 is a comparison graph showing PQ (static pressure-air quantity) characteristics on impellers. In FIG. 3, (a) indicates characteristic on a general-use single suction type centrifugal fan having no turbulence suppressing plate, (b) indicates characteristic on a conventional single suction type centrifugal fan having a turbulence suppressing plate, (c) indicates characteristic on a single suction type centrifugal fan having only main plate openings, and (d) indicates characteristic on the single suction type centrifugal fan according to this exemplary embodiment having both the main plate openings and the rotary shaft surrounding space.

This single suction type centrifugal fan having only main plate openings 18 whose characteristic is indicated by (c) in FIG. 3 exhibits a static pressure on a shutoff side higher than that of the general-use single suction type centrifugal fan whose characteristic is indicated by (a) in FIG. 3. Further, the single suction type centrifugal fan having only main plate openings 18 whose characteristic is indicated by (c) in FIG. 3 exhibits the substantially same static pressure characteristic as that of the single suction type centrifugal fan having the turbulence suppressing plate whose characteristic is indicated by (b) in FIG. 3.

In the single suction type centrifugal fan according to this exemplary embodiment having main plate openings 18 and rotary shaft surrounding space 22 whose characteristic is indicated by (d) in FIG. 3, a static pressure on a shutoff side is further increased, and the single suction type centrifugal fan according to this exemplary embodiment exhibits a higher static pressure characteristic than the centrifugal fan having only main plate openings 18 whose characteristic is indicated by (c) in FIG. 3.

In this manner, according to the single suction type centrifugal fan of this exemplary embodiment, it is possible to acquire an advantageous effect that the single suction type centrifugal fan can acquire a high static pressure when the device is used on a shutoff side on a performance (PQ) curve without additionally providing a part such as a turbulence suppressing plate to a product.

Second Exemplary Embodiment

A single suction type centrifugal fan according to the second exemplary embodiment of the present disclosure is described with reference to FIG. 4A and FIG. 4B. The components identical with the components of the first exemplary embodiment are given the same symbols and the detailed description thereof is omitted.

Figure 4B:
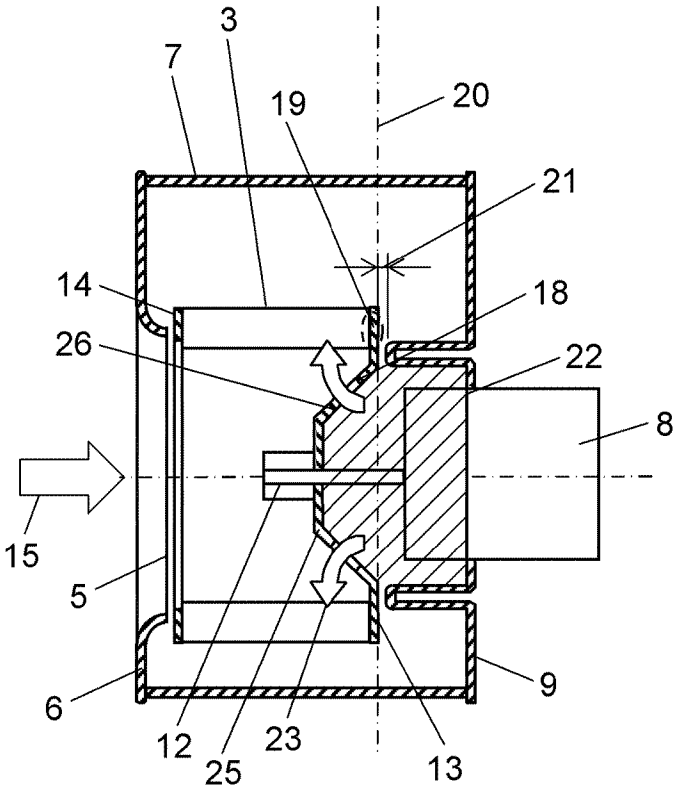
FIG. 4B is a front cross-sectional view showing a configuration of the single suction type centrifugal fan according to the second exemplary embodiment of the present disclosure.
Figure 4A:
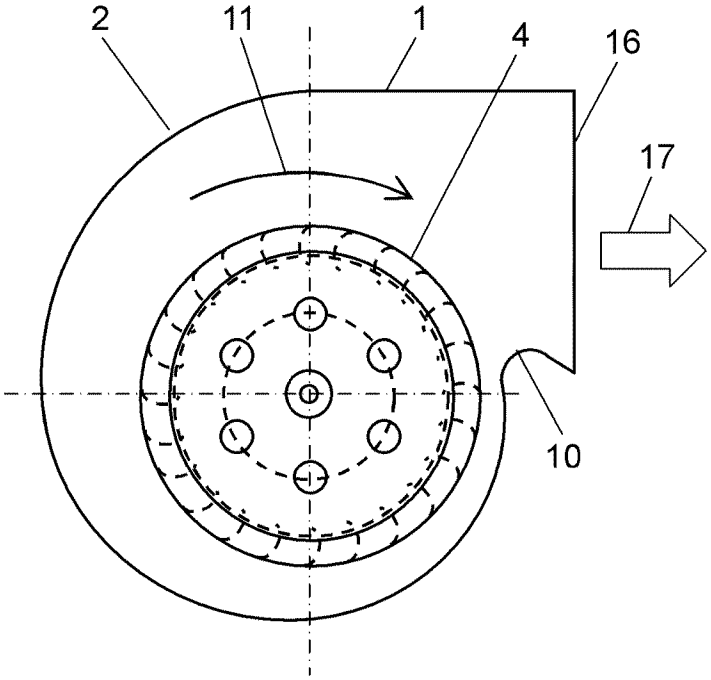
FIG. 4A is a side view showing a configuration of a single suction type centrifugal fan according to a second exemplary embodiment of the present disclosure.

In single suction type centrifugal fan 1 shown in FIG. 4A and FIG. 4B, impeller main plate projecting portion 25 which projects toward suction port 5 side from motor fixing side plate 9 side is formed on impeller main plate 13 of impeller 4.

A center portion of impeller main plate 13 which is fixed to motor 8 is mounted on impeller main plate projecting portion 25.

Impeller main plate projecting portion 25 is formed into a projecting shape having a cross sectional area (cross-sectional area in the direction perpendicular to rotary shaft 12) gradually decreasing toward the suction port 5 side from the motor fixing side plate 9 side. Main plate openings 18 are formed in inclined portion 26 of the projecting portion of impeller main plate projecting portion 25.

A projecting shape of impeller main plate projecting portion 25 may preferably be a frustoconical shape or a conical shape.

Main plate openings 18 are distributed equidistantly on the circumference about rotary shaft 12 of motor 8.

The operation and advantageous effects acquired by the above-mentioned configuration are described.

Due to the provision of impeller main plate projecting portion 25, rotary shaft surrounding space 22 can be further increased and hence, when the device is used on a shutoff side on a performance (PQ) curve, a usable volume of casing 2 can be further increased.

By forming main plate openings 18 in inclined portion 26, the direction of a gas flow which flows into impeller 4 from space 22 can be directed toward a blades 3 side. That is, it is possible to make the direction along which a gas flow is pulled in impeller 4 and the direction of a gas flow which flows into impeller 4 from rotary shaft surrounding space 22 agree with each other. Accordingly, a gas flow smoothly flows into impeller 4 from rotary shaft surrounding space 22 thus further increasing a static pressure.

Further, by distributing main plate openings 18 equidistantly on the circumference about rotary shaft 12 of motor 8, it is possible to prevent impeller 4 from becoming unbalanced attributed to manufacturing irregularity at the time of forming main plate openings 18.

In this manner, according to single suction type centrifugal fan 1 of this exemplary embodiment, the following advantageous effects can be acquired without additionally providing a part such as a turbulence suppressing plate to a product. That is, according to single suction type centrifugal fan 1 of this exemplary embodiment, when single suction type centrifugal fan 1 is used on a shutoff side on a performance (PQ) curve, single suction type centrifugal fan 1 can acquire a higher static pressure while simplifying the unbalance adjustment of impeller 4.

In the exemplary embodiment, a width of constriction portion 21, that is, a distance between blade end portion imaginary plane 20 and motor fixing side plate 9 in constriction portion 21 in the direction parallel to rotary shaft 12 is preferably set to a value which falls within a range from 1 mm to 10 mm. It is needless to say, however, that even when the width of constriction portion 21 is set to a value which does not fall within the range from 1 mm to 10 mm, single suction type centrifugal fan 1 can acquire the advantageous effects of the present disclosure.

In this exemplary embodiment shown in FIG. 4B, constriction portion 21 is formed in the vicinity of end portions 19 of blades 3, and constriction portion 21 is formed between an area in the vicinity of end portions 19 of blades 3 and motor fixing side plate 9. However, it is sufficient that constriction portion 21 is formed between main plate openings 18 and blades 3 and hence, constriction portion 21 may be formed in an area other than the area in the vicinity of end portions 19 of blades 3.

As has been described heretofore, in the single suction type centrifugal fan according to the exemplary embodiment of the present disclosure, a constriction portion is formed where a distance between a blade end portion imaginary plane and the motor fixing side plate becomes narrower between the main plate opening and the blades, where the blade end portion imaginary plane is defined as a plane which passes end portions of the blades on a motor fixing side plate side and is perpendicular to a rotary shaft of the motor. The constriction portion is formed where the distance between the blade end portion imaginary plane and the motor fixing side plate is narrowed between the main plate openings and the blades, and the rotary shaft surrounding space which is communicated with the inside of the casing through the constriction portion is formed between the impeller main plate and the motor fixing side plate such that the rotary shaft surrounding space surrounds the rotary shaft of the motor. The space is communicated with the impeller through the main plate openings formed in impeller main plate, and gas in the rotary shaft surrounding space is pulled toward the impeller side due to the rotation of the impeller whereby a gas pressure in the space becomes a negative pressure. When a high static pressure is applied to the device, that is, when the device is used on a shutoff side on a performance (PQ) curve, a pressure is boosted by the impeller and the casing, and part of gas which flows into the casing is introduced into the space where a gas pressure is a negative pressure from the casing where a gas pressure is a positive pressure through the constriction portion. Gas which flows into the rotary shaft surrounding space through the constriction portion flows into the impeller through the main plate openings, and a pressure of the gas is boosted again by the impeller and the casing. Due to such operation, a static pressure when the centrifugal fan is used on a shutoff side on a performance (PQ) curve can be increased.

Due to the provision of the constriction portion formed between the inside of the casing and the space, it is possible to prevent a phenomenon that gas having a high flow speed in the casing flows into the space in a single stroke. Accordingly, it is possible to allow gas to smoothly flow into the impeller without generating turbulence in a gas flow in the space.

The impeller main plate projecting portion which projects toward the suction port side may be formed on the impeller main plate, and the center portion of the impeller main plate may be mounted on the impeller main plate projecting portion, and the impeller main plate projecting portion may be formed into a projecting shape having a cross sectional area gradually decreasing toward the suction port side, and the main plate openings may be formed in the inclined portion of the projecting portion. By forming main plate openings in the inclined portion, the direction of a gas flow which flows into the impeller from the rotary shaft surrounding space can be directed toward the blades side. That is, it is possible to make the direction along which a gas flow is pulled in the impeller and the direction of a gas flow which flows into the impeller from the rotary shaft surrounding space agree with each other. Accordingly, a gas flow smoothly flows into the impeller from the rotary shaft surrounding space thus further increasing a static pressure.

The projecting shape may be a frustoconical shape or a conical shape. By adopting such shapes, a gas flow further smoothly flows into the impeller from the rotary shaft surrounding space thus further increasing a static pressure.

Further, the main plate openings may be distributed equidistantly on the circumference about the rotary shaft of the motor. Due to such an arrangement, it is possible to suppress the impeller from becoming unbalanced attributed to manufacturing irregularity at the time of forming the main plate openings.

The constriction portion may be formed in the vicinity of the end portions of the blades. Due to such a configuration, a volume of the rotary shaft surrounding space can be increased.

The width of the constriction portion may be set to a value which falls within a range from 1 mm to 10 mm. Due to such setting, a gas flow moderately flows into the rotary shaft surrounding space from the inside of the casing.

What is claimed is:

1. A single suction centrifugal fan comprising:

a motor;

a casing having a spiral shape; and an impeller housed in the casing, the impeller having a plurality of blades, an impeller main plate and an auxiliary ring to which the blades are fixed, the casing including a suction side plate having a suction port, and a motor fixing side plate to which the motor is fixed, the impeller main plate having a center portion fixed to the motor, wherein both of the impeller main plate and an auxiliary ring are planar, the impeller main plate has a main plate opening formed between the blades and the center portion of the impeller main plate, a constriction portion is formed between the main plate and the motor fixing side plate by projecting a portion of the motor fixing side plate towards the main plate, in a region between the outer side of the main plate opening and the inner side of the blades, the constriction portion projects in a direction of a blade end portion imaginary plane, the constriction portion being closer to the blade end portion imaginary plane than an end of the motor except the motor shaft, and a distance between the motor fixing side plate and a blade end portion imaginary plane is narrower at the constriction portion than a distance between the blade end portion imaginary plane and the motor fixing side plate where the constriction portion is not formed, where the blade end portion imaginary plane is defined as a plane which passes end portions of the blades on a motor fixing side plate side and is perpendicular to a rotary shaft of the motor.

2. The single suction type centrifugal fan according to claim 1, wherein an impeller main plate projecting portion which projects toward a suction port side from a motor fixing side plate side is formed on the impeller main plate, the center portion of the impeller main plate is formed on the impeller main plate projecting portion, the impeller main plate projecting portion is formed into a projecting shape having a cross sectional area gradually decreasing toward the suction port side from the motor fixing side plate side, and the main plate opening is formed in an inclined portion of the projecting portion.

3. The single suction type centrifugal fan according to claim 2, wherein the projecting shape is a frustoconical shape or a conical shape.

4. The single suction type centrifugal fan according to claim 1, wherein the main plate openings are distributed equidistantly along a circumference about a rotary shaft of the motor.

5. The single suction type centrifugal fan according to claim 1, wherein the constriction portion is disposed in a vicinity of the end portions of the blades.

6. The single suction type centrifugal fan according to claim 1, wherein a width of the constriction portion is 1 mm to 10 mm.

* * * * *